US012215691B2

(12) United States Patent
Coeckelbergs

(10) Patent No.: US 12,215,691 B2
(45) Date of Patent: Feb. 4, 2025

(54) METHOD FOR OPERATING A VACUUM PUMP SYSTEM AND VACUUM PUMP SYSTEM APPLYING SUCH METHOD

(71) Applicant: ATLAS COPCO AIRPOWER, NAAMLOZE VENNOOTSCHAP, Wilrijk (BE)

(72) Inventor: Joeri Coeckelbergs, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 25 days.

(21) Appl. No.: 17/391,086

(22) Filed: Aug. 2, 2021

(65) Prior Publication Data

US 2021/0404469 A1 Dec. 30, 2021

Related U.S. Application Data

(63) Continuation of application No. 16/077,780, filed as application No. PCT/BE2017/000014 on Feb. 13, 2017, now Pat. No. 11,111,922.

(Continued)

(30) Foreign Application Priority Data

Jan. 10, 2017 (BE) ..... 2017/5008

(51) Int. Cl.
*F04C 28/02* (2006.01)
*F04B 37/14* (2006.01)

(Continued)

(52) U.S. Cl.
CPC ..... *F04C 28/02* (2013.01); *F04B 37/14* (2013.01); *F04B 41/06* (2013.01); *F04B 49/08* (2013.01);

(Continued)

(58) Field of Classification Search
CPC ..... F04C 28/02; F04C 18/16; F04C 23/00; F04C 23/001; F04C 23/003; F04C 25/02;

(Continued)

(56) References Cited

U.S. PATENT DOCUMENTS 3,744,932 A 7/1973 Prevett
4,259,038 A * 3/1981 Jorgensen ..... G05D 16/2073 417/5

(Continued)

FOREIGN PATENT DOCUMENTS

DE 102008064490 A1 6/2010
DE 102013108090 A1 1/2015

(Continued)

OTHER PUBLICATIONS

International Search Report in related PCT Application No. PCT/BE2017/000014, dated Aug. 31, 2017.

(Continued)

*Primary Examiner* — Charles G Freay
(74) *Attorney, Agent, or Firm* — BACON & THOMAS, PLLC

(57) ABSTRACT

A method of operating a vacuum pump system, the method including the steps of: operating a primary vacuum pump having a variable speed motor; connecting at least two secondary vacuum pumps in parallel with said primary vacuum pump; dividing the secondary vacuum pumps in groups, each group including at least one secondary vacuum pump; and assigning a priority for each of said groups. The method further includes the steps of measuring the inlet pressure p1, comparing the measured inlet pressure p1 with a predetermined pressure value p0, and if p1 is higher than p0, starting the secondary vacuum pump at a first predetermined startup load $S_{startup,1}$ if it includes a fixed speed motor, and/or starting the secondary vacuum pump at a (Continued)

second predetermined startup load $S_{startup,2}$, if it includes a variable speed motor.

20 Claims, 3 Drawing Sheets

Related U.S. Application Data

(60) Provisional application No. 62/298,788, filed on Feb. 23, 2016.

(51) Int. Cl.

| | |
|---|---|
| ***F04B 41/06*** | (2006.01) |
| ***F04B 49/06*** | (2006.01) |
| ***F04B 49/08*** | (2006.01) |
| ***F04C 23/00*** | (2006.01) |
| ***F04C 25/02*** | (2006.01) |

(52) U.S. Cl.
CPC ..... *F04C 23/001* (2013.01); *F04C 25/02* (2013.01); *F04B 49/065* (2013.01)

(58) Field of Classification Search
CPC ..... F04C 2240/403; F04C 2270/18; F04C 2270/42; F04B 37/14; F04B 41/06; F04B 49/08; F04B 49/007; F04B 49/022; F04B 49/20; F04B 49/065
See application file for complete search history.

(56) References Cited

U.S. PATENT DOCUMENTS

| | | | | |
|---|---|---|---|---|
| 4,502,842 | A * | 3/1985 | Currier | F04B 49/065 417/63 |
| 4,655,688 | A | 4/1987 | Bohn et al. | |
| 5,231,846 | A | 8/1993 | Goshaw et al. | |
| 5,522,707 | A | 6/1996 | Potter | |
| 6,659,726 | B2 | 12/2003 | Holden | |
| 8,192,171 | B2 * | 6/2012 | Mehaffey | F04C 28/08 417/2 |
| 8,371,821 | B1 | 2/2013 | Mehr | |
| 9,399,990 | B2 * | 7/2016 | Stellnert | F04B 37/14 |
| 11,111,922 | B2 * | 9/2021 | Coeckelbergs | F04C 28/02 |
| 2011/0129355 | A1 | 6/2011 | Hofseth et al. | |
| 2011/0286860 | A1 | 11/2011 | Oppel | |
| 2015/0044071 | A1 | 2/2015 | Huser | |
| 2018/0112666 | A1 | 4/2018 | Dreifert et al. | |

FOREIGN PATENT DOCUMENTS

| | | | |
|---|---|---|---|
| DE | 202015004596 | U1 | 9/2015 |
| WO | 2008121051 | A1 | 10/2008 |
| WO | 2014040627 | A1 | 3/2014 |
| WO | 2015039282 | A1 | 3/2015 |

OTHER PUBLICATIONS

Written Opinion in related PCT Application No. PCT/BE2017/000014, dated Aug. 31, 2017.

* cited by examiner

METHOD FOR OPERATING A VACUUM PUMP SYSTEM AND VACUUM PUMP SYSTEM APPLYING SUCH METHOD

CROSS REFERENCE TO RELATED APPLICATIONS

This application is a continuation application of U.S. application Ser. No. 16/077,780, filed Aug. 14, 2018, now U.S. Pat. No. 11,111,922 granted Sep. 7, 2021, which is the national stage entry of International Application PCT/BE2017/000014, filed Feb. 13, 2017, which claims priority to U.S. Provisional Application No. 62/298,788, filed Feb. 23, 2016, and to Belgian application BE 2017/5008, filed Jan. 10, 2017, which are all incorporated by reference.

FIELD OF THE INVENTION

This invention relates to a method of operating a vacuum pump system, the method comprising the steps of: operating a primary vacuum pump comprising a variable speed motor; connecting at least two secondary vacuum pumps in parallel with said primary vacuum pump, each of the at least two secondary vacuum pumps comprising a motor; dividing the secondary vacuum pumps in groups, each group comprising at least one secondary vacuum pump, and assigning a priority for each of said groups.

BACKGROUND OF THE INVENTION

Systems comprising a plurality of vacuum pumps exist, like for example the system disclosed in U.S. Pat. No. 5,522,707 B in the name of Metropolitan Industries, Inc. The system described therein uses a controller unit for starting an additional pump when the demand for vacuum increases. When a variable speed vacuum pump reaches the maximum output, the controller unit starts a fixed speed vacuum pump and stops the variable speed vacuum pump.

Such a system and control logic is not suitable for all types of applications. If we take the example in which the variable speed pump is of a higher capacity than a fixed speed pump, such a control logic can create undesired fluctuations that will affect the user's application.

Moreover, such a control logic will not avoid the situation in which the system is either under-designed or over-designed for the application to which it is connected, since it considers the startup of a fixed speed pump equivalent with the functioning capability of a variable speed pump running at maximum output.

Furthermore, such a control logic would not allow a user of the system to control the energy efficiency of the system or to minimize maintenance costs, since the user is not able to influence which of the vacuum pumps is running.

SUMMARY OF THE INVENTION

Taking the above mentioned drawbacks into account, it is an object of the present invention to provide a pump system adapting its capacity to a varying demand for a user application. Accordingly, the pump system will neither be under-designed nor over-designed, even if the demand of the user's applications changes over time.

It is another object of the present invention to provide a pump system allowing a user to adapt the response time of the system according to the application requirements. The invention further allows the user to reduce its maintenance costs and achieve an equal wear for the pumps part of the system.

Accordingly, the present invention aims at providing a flexible, easily controllable and low cost incurring vacuum system being equally suitable for different applications having different pressure requirements, without special service interventions.

The present invention solves at least one of the above and/or other problems by providing a method of operating a vacuum pump system, the method comprising the steps of:

- operating a primary vacuum pump comprising a variable speed motor;
- connecting at least two secondary vacuum pumps in parallel with said primary vacuum pump, each of the at least two secondary vacuum pumps comprising a motor;
- dividing the secondary vacuum pumps in groups, each group comprising at least one secondary vacuum pump;
- assigning a priority for each of said groups;

whereby the method further comprises the steps of:

- conducting a first measurement of the inlet pressure at an inlet of the vacuum pump system;
- comparing the first measured inlet pressure with a predetermined pressure value and, if said measured inlet pressure is higher than said predetermined pressure value, operating the at least one secondary vacuum pump part of the group having the highest priority assigned to it;
- conducting a second measurement of the inlet pressure at the inlet of the vacuum pump system;
- comparing the second measured inlet pressure with said predetermined pressure value and, if, said second measured inlet pressure is higher than the predetermined pressure value, operating the at least one secondary vacuum pump of the group having a second highest priority assigned to it, whereby, the method further comprises the step of starting said secondary vacuum pumps at a first predetermined startup load if it comprises a fixed speed motor, and/or starting said secondary vacuum pump at a second predetermined startup load, if said secondary vacuum pump comprises a variable speed motor.

Indeed, by dividing the secondary vacuum pumps in groups and assigning a priority for each of the groups, a better control on the working hours of each of the vacuum pumps is achieved. Because of this, the maintenance process for each of the vacuum pumps can be better anticipated.

By starting the secondary vacuum pump at a first predetermined startup load or at a second predetermined startup load depending if it comprises a fixed speed motor or a variable speed motor, the vacuum pump system allows for a better control of the pressure obtained at the inlet of the vacuum pump system and a better control on the load of every vacuum pump, which influences the wear of each pump and accordingly the time interval in which maintenance will have to be performed. Accordingly, the demand for a user's application is met without the risk of having an over-designed or under-designed vacuum pump system.

Moreover, such a method can be implemented within a system comprising vacuum pumps of different capacities, or even comprising a combination of vacuum pumps achieving both high vacuum as well as low vacuum levels, and, for all the required vacuum levels, the vacuum pump system is controlled in a very simple manner by implementing the method as defined herein.

Moreover, by starting a secondary vacuum pump at a second predetermined startup load, the inlet pressure can be reduced sequentially and only to such extent to meet the user's demand. Accordingly, if the vacuum pump system comprises a high capacity pump, such pump will not run at a higher load than requested by the user's application. Consequently, a high capacity pump can achieve a high, medium or low capacity in an efficient way, without having the risk of having an under-designed or overdesigned system to match the flow and accordingly the demand of the user's network.

By applying the method according to the present invention, the vacuum pump system can be easily adapted to meet different vacuum demands, and can therefore be used for different applications without the need of a manual intervention.

Moreover, because the vacuum pumps are not started at a maximum load and because the method according to the present invention divides the secondary vacuum pumps into groups and operates them depending on the priority assigned, an equal wear of all the vacuum pumps can be achieved.

Furthermore, depending on where a user of a vacuum pump system according to the present invention is located geographically, the costs incurred by the functioning of the vacuum pump system can differ according to, for example: the price of electricity, environmental conditions, or even ease of accessibility for maintenance. Consequently, in some geographical areas an energy optimization can be required, while in others a wear optimization can be a better solution.

The method according to the present invention is feasible for both such situations because the secondary vacuum pumps are started at the first predetermined startup load and at the second predetermined startup load, respectively. Depending if the first predetermined startup load and the second predetermined startup load are selected at a relatively high level or at a relatively low level, the user of the vacuum pump system according to the present invention chooses which of the two options of efficiency he needs: either the maintenance optimization of the vacuum pump system, or the energy consumption optimization respectively.

Preferably the vacuum pump system comprises oil injected screw vacuum pumps, which are known to be more efficient at lower speeds than at higher speeds.

In a preferred embodiment according to the present invention, the user of the vacuum pump system chooses which option he prefers by selecting the value of the second predetermined startup load: if the second predetermined startup load is selected at a relatively low value, which implies that the speed of the vacuum pump will be relatively low, the energy efficiency is high and there will be a relatively high number of pumps running in order to meet the demand. Whereas, if the second predetermined startup load is selected at a relatively high value, which implies that the speed of the vacuum pump is relatively high, then the efficiency of the vacuum pumps is lower than in the previous case but an equal wear of the vacuum pumps will be achieved, because the number or running hours of the secondary vacuum pumps part of the same group can be better controlled, which means that fewer vacuum pumps will require service interventions in a time interval.

Preferably, the vacuum pump system starts a secondary vacuum pump when the primary vacuum pump is running at a first maximum load.

The present invention is further directed to a vacuum pump system comprising:

- a primary vacuum pump comprising a variable speed motor;
- at least two secondary vacuum pumps, connected in parallel with said primary vacuum pump, each of said at least two secondary vacuum pumps comprising a motor;
- a pressure sensor for measuring the inlet pressure of the vacuum pump system at an inlet thereof;
- control means comprising communication means for communicating with one or more of: said primary vacuum pump and said at least two secondary vacuum pumps;

whereby said control means further comprises processing means comprising an algorithm configured to apply the method according to the present invention.

BRIEF DESCRIPTION OF THE DRAWINGS

With the intention of better showing the characteristics of the invention, some preferred configurations according to the present invention are described hereinafter by way of an example, without any limiting nature, with reference to the accompanying drawings, wherein.

DETAILED DESCRIPTION OF THE INVENTION

Figure 1:
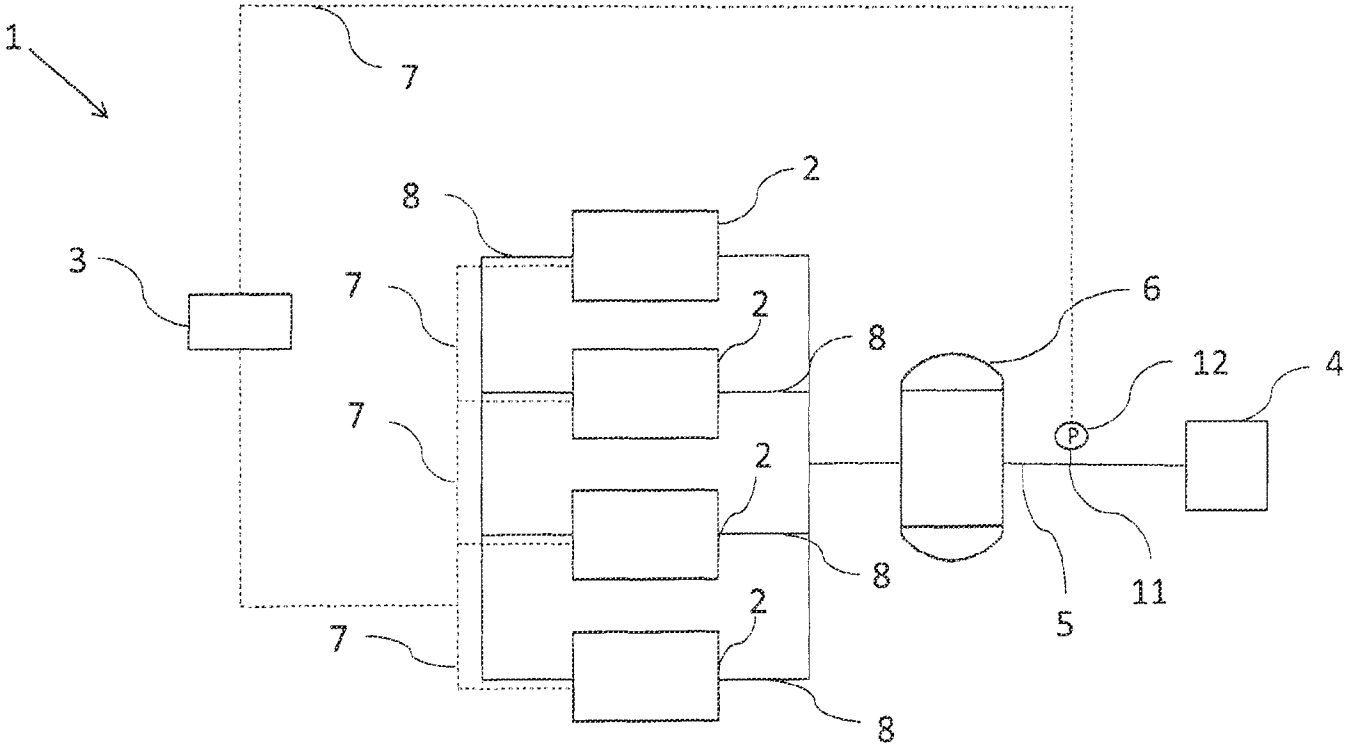
FIG. 1 schematically represents a vacuum pump system according to an embodiment of the present invention.

FIG. 1 illustrates a vacuum pump system 1 comprising a plurality of vacuum pumps 2 and a control unit 3 controlling said vacuum pumps 2. The system is being further connected to a user of vacuum 4 within an external user's network through a flow conduit 5. The vacuum pump system 1 can further comprise a buffer vessel 6 connected to an inlet 11 of the vacuum pump system for receiving fluid. Such a buffer vessel 6 increases the stability of the vacuum pump system 1 because it assures a volume of fluid immediately ready for the user's network 4.

Said control unit 3 is controlling said vacuum pumps 2 through an electrical connection 7.

In FIG. 1 an example of a vacuum pump system according to the present invention is illustrated, such system comprising four vacuum pumps 2, interconnected by a flow conduit 8.

The present invention should not be limited to a vacuum pump system 1 comprising only four vacuum pumps 2. The method according to the present invention is applicable within systems comprising less vacuum pumps 2 as well as more vacuum pumps 2, like for example a vacuum pump system 1 comprising three, or more than four vacuum pumps 2.

Preferably, one of the vacuum pumps 2 is identified as the primary vacuum pump 9. Preferably, said primary vacuum pump 9 comprises a variable speed motor (not illustrated), such that its load can be gradually increased. At least two secondary vacuum pumps 10 are connected in parallel with said primary vacuum pump 9, each of the at least two secondary vacuum pumps 10 comprising a motor (not illustrated).

The functioning principle is very simple and as follows.

A request for vacuum is received from the user of vacuum 4 and a primary vacuum pump 9 is operated by the control unit 3, the load of said primary vacuum pump 9 being operated between a first minimum load $S_{min,1}$ and a first maximum load $S_{max,1}$.

Preferably, when the control unit 3 operates the primary vacuum pump 9, it starts said primary vacuum pump 9 at a load between the first minimum load $S_{min,1}$ and a first maximum load $S_{max,1}$, but preferably lower than said first maximum load $S_{max,1}$, and gradually increases such load in order to meet the demand of the user of vacuum 4.

For example, the primary vacuum pump 9 can be started at a load, $S_{startup,0}$, selected between 10% and 90%, such as for example and not limiting to: at a 30% load, at a 40% load, at 50% load, or at 60% load, or any intermediary value thereof.

In an embodiment according to the present invention, such a load can be gradually increased with a percentage, k0, selected between 5% and 50%, depending on the application and the user's preferences, such as for example and not limiting to, the load can be increased by: 10% load, or 20% load, or 30% load, or any other intermediary value thereof, depending on the characteristics of the user's network and the response time required.

Preferably, but not limiting to, the primary vacuum pump 9 is started at $S_{startup,0}$=40% load and such a load can be gradually increased with k0=20%. Such increase is applied until the primary vacuum pump 9 is running at a first maximum load, $S_{max,1}$.

In another embodiment according to the present invention, the primary vacuum pump 6 is controlled by for example, and not limiting to, a proportional integrating (PI) or a proportional integrating derivative (PID) controller (not shown). Preferably, the control unit 3 communicates with said PI or PID controller.

Accordingly, the control unit 3 preferably starts the primary vacuum pump 9 at a load, $S_{startup,0}$, and the PI or PID controller preferably adapts it's load continuously in order to maintain a stable pressure, p1, at an inlet 11 of the vacuum pump system 1 and with the aim of achieving the predetermined pressure value, p0, required by the user's network 4. Said PI or PID controller will consequently continuously adapt the speed of the motor operating said primary vacuum pump 9 and the flow said primary vacuum pump 9 provides in order to meet the requirements of the user's network 4, until said primary vacuum pump reaches its maximum load, $S_{max,1}$.

If the primary vacuum pump 9 is operated at a first maximum load, $S_{max,1}$, and the pressure value, p1, measured at the inlet 11 is not equal to or lower than a predetermined pressure value, p0, the control unit 3 will operate a secondary vacuum pump 10. It should be understood that said predetermined pressure value, p0, corresponds to the demand of the user of vacuum 4.

Preferably, the at least two secondary vacuum pumps 10 are operated between a second minimum load, $S_{min,2}$, and a second maximum load, $S_{max,2}$.

In the context of the present invention is should be understood that said first minimum load, $S_{min,1}$, can be equal to the second minimum load, $S_{min,2}$, or such loads can have different values. Moreover, different secondary vacuum pumps 10 can have different second minimum loads, $S_{min,2}$.

It should be understood that the same logic applies for the first maximum load, $S_{max,1}$, and the second maximum load, $S_{max,2}$.

In an embodiment according to the present invention, the first minimum load, $S_{min,1}$, the second minimum load $S_{min,2}$, the first maximum load, $S_{max,1}$, and the second maximum load, $S_{max,2}$, respectively, are selected at a value higher than the absolute minimum load and at a value lower than the absolute maximum load of the vacuum pump, such that the lifetime of the motors driving the vacuum pumps 2 is increased.

Preferably, the secondary vacuum pumps 10 are divided in groups, each group comprising at least one secondary vacuum pump 10 and a priority is assigned for each of said groups.

In the context of the present invention it should be understood that the priority defines the order in which the control unit selects the groups and operates the at least one secondary vacuum pump 10 part of such a group.

As an example, but not limiting to, such a priority can be in the form of a number or a letter, or any other type of distinction that can be made for each group. Further, a logic is assigned to the priority, said logic defining the highest and the lowest priority and therefore the order in which the control unit 3 selects the groups and starts and/or stops the secondary vacuum pumps 10.

If the pressure value, p1, measured at the inlet 11 of the vacuum pump system is not equal to or lower than the predetermined pressure value, p0, the control unit 3 selects, for example, the group with the highest priority assigned and operates a secondary vacuum pump 10 part of this group.

Further, the control unit 3 compares the pressure value, p1, measured at the inlet 11 with the predetermined pressure value, p0, and, if the pressure value, p1, measured at the inlet 11 is still higher than the predetermined pressure value, p0, the control unit 3 is operating the at least one secondary vacuum pump 10 of the group having a second highest priority assigned to it. It should be understood that a group can comprise more than one secondary vacuum pump 10, and if that is the case, the control unit 3 will preferably operate another secondary vacuum pump 10 part of the same group.

If the group does not have another secondary vacuum pump 10 that can be operated, the control unit 3 will select the group with the next highest priority from the remaining groups and operates a secondary vacuum pump 10 part of this group.

In the context of the present invention the load should be understood as the power of the motor driving a vacuum pump 2.

It should be further understood that the load of a vacuum pump 2 is directly dependent on the rotational speed of the motor, on the pressure value, p1, measured at the inlet 11 and the volume of fluid the vacuum pump system 1 needs to deliver in order to meet the requirements of the user's network 4, hereinafter referred to as the flow. It should be further understood that if the speed of a motor controlling a vacuum pump 2 is increased, the intensity of the current running through said motor is increased, which means that the load of said vacuum pump 2 increases. Accordingly, if the flow demand increases at the user's network 4, the pressure value, p1, measured at the inlet 11 increases and, in order to maintain constant such a pressure value, p1, the control unit 3 increases the speed of a vacuum pump 2, which consequently means that the load of the motor operating such vacuum pump 2 increases.

In the context of the present invention, it should be understood that the secondary vacuum pumps 10 part of the same group have the same group priority assigned to them. Because of this, a better control of the number of running hours of each of the secondary vacuum pumps 10 can be achieved by defining the order and which of the secondary vacuum pumps are being operated.

Further, by operating a vacuum pump 2 it should be understood that the control unit 2 is starting such vacuum pump 2, and controls the load of said vacuum pump 2.

In another embodiment according to the present invention, but not limiting to, the control unit 3 can further assign priorities for the secondary vacuum pumps 10 part of the same group, such that a clear order is defined in which these secondary vacuum pumps 10 are operated.

For example, and not limiting to, the control unit 3 operates first the secondary vacuum pump 10 part of such a group, said secondary vacuum pump being identified as having the least number of running hours.

Further, the control unit 3 will preferably operate a secondary vacuum pump 10, part of the same group and identified as having the next least number of running hours.

Preferably, such steps are repeated until all the secondary vacuum pumps 10 part of the same group have been operated. If further needed, the control unit 3 will preferably apply the same logic to the group having the next highest priority from the remaining groups.

Preferably, a secondary vacuum pump 10 is started at a first predetermined startup load, $S_{startup,1}$, if it comprises a fixed speed motor, and/or said secondary vacuum pump 10 is started at a second predetermined startup load, $S_{startup,2}$, if said secondary vacuum pump 10 comprises a variable speed motor.

In another embodiment according to the present invention, the method is repeating the step of comparing the measured inlet pressure, p1, with the predetermined pressure value, p0, and if, the subsequently measured pressure, p1, at the inlet 11 is higher than the predetermined pressure value, p0, operating the at least one secondary vacuum pump 10 part of the group having a next highest priority assigned to it, until the pressure, p1, measured at the inlet 11 reaches the value of the predetermined pressure value, p0, or until all the secondary vacuum pumps are running.

In a preferred embodiment according to the present invention, operating at least one secondary vacuum pump 10 part of the group with the highest priority is done by starting one secondary vacuum pump 10 at a time, and if the pressure, p1, measured at the inlet 11 is higher than the predetermined pressure value, p0, the vacuum pump system 1 starts another secondary vacuum pump 10 part of said same group with the highest priority or, if all the vacuum pumps of said group with the highest priority are running, the method further comprises the step of starting a secondary vacuum pump 10, part of the group with the second highest priority.

Preferably, operating at least one secondary vacuum pump 10 part of the group with the second highest priority is done by starting one secondary vacuum pump 10 at a time, and if the measured inlet pressure, p1 is higher than the predetermined pressure value, p0, the vacuum pump system 1 starts another secondary vacuum pump 10 part of said same group with second highest priority or, if all the secondary vacuum pumps 10 of said group with the second highest priority are running, the method further comprises the step of starting a secondary vacuum pump 10, part of the group with the next highest priority.

In one embodiment according to the present invention, and not limiting to, if a secondary vacuum pump 10 which is being operated by the control unit 3 comprises a variable speed motor, the control unit will identify such secondary vacuum pump 10 as the new primary vacuum pump 9, and will identify the previous primary vacuum pump 9 as a secondary vacuum pump 10. Preferably, if the secondary vacuum pump 10 comprises a variable speed motor, then the second predetermined startup load, $S_{startup,2}$ is lower than the second maximum load, $S_{max,2}$. If the secondary vacuum pump 10 comprises a fixed speed motor, then the first predetermined startup load, $S_{startup,1}$ has approximately the same value to the second maximum load, $S_{max,2}$.

In another embodiment, but not limiting to, all the secondary vacuum pumps 10 have a variable speed motor, and the control unit 3 is preferably starting each of the secondary vacuum pumps 10 at a second predetermined startup load, and maintains such a load constant. Accordingly, the vacuum pump system is much more stable and easily controllable.

In such a case, the primary vacuum pump 9 can either remain the vacuum pump 2 with the least number of running hours from the group with the highest priority assigned to it, or it can be identified as the last secondary vacuum pump 10 operated, said secondary vacuum pump 10 comprising a variable speed motor. It is preferred that when the control unit 3 identifies a secondary vacuum pump 10 as being the new primary vacuum pump 9, the capacity of the newly identified primary vacuum pump 9 will match the capacity of the previously identified primary vacuum pump 9, such that no fluctuation will be experienced by the user of vacuum 4.

In a preferred embodiment according to the present invention, the vacuum pumps 2 part of the vacuum pump system 1 are first split into groups and priorities are assigned to such groups. The priority can be assigned according to the capacity of each vacuum pump 2, such as for example and not limiting to: the highest priority can be assigned to the group of vacuum pumps 2 having the highest capacity, the next highest priority can be assigned to the group of vacuum pumps 2 having the next highest capacity. Such a step is repeated until the lowest priority is assigned, to the group of vacuum pumps 2 having the lowest capacity.

It should be understood that such priority can be selected in a different manner according to the customer's requirements.

If one of the groups comprises more than one vacuum pump 2, the control unit 3 compares the number or running hours of such vacuum pumps 2 and assigns an order in which these vacuum pumps 2 are being operated.

In such a case, the primary vacuum pump 9 is preferably selected as the vacuum pump 2 part of the group with the highest priority assigned to it and having the least number of running hours.

Preferably, the primary vacuum pump 9 always comprises a variable speed motor.

It should be understood that the control unit 3 can also apply a different logic for selecting the primary vacuum pump 9, such as for example, by comparing the number of running hours of all the vacuum pumps 2 part of the vacuum pump system 1 and selecting the vacuum pump 2 having the least number of running hours.

In a preferred embodiment according to the present invention, if the secondary vacuum pump 10 comprises a fixed speed motor, the first predetermined startup load, $S_{startup,1}$, is the same value as the second maximum load, $S_{max,2}$, which is preferably 100%. If the secondary vacuum pump 10 comprises a variable speed motor, its startup load, is preferably selected as the second predetermined startup load, $S_{startup,2}$, having a value selected between 10% and 90%, such as for example and not limiting to, at 30% load, or 40% load, or 50% load, or any other intermediary or higher value of the interval.

Preferably, the control unit 3 measures the pressure, p1, at the inlet 11 of the vacuum pump system 1 and compares the measured inlet pressure, p1, with the predetermined pressure value, p0, after a control time interval. By applying such a logic, the computational power of the overall system is maintained to a minimum, while maintaining a small response time of the system.

It is also possible for one variable speed motor to control two or more vacuum pumps 2 connected in parallel, each of such vacuum pumps 2 being individually operated. It is also possible for these vacuum pumps 2 to be controlled by the same motor and be operated simultaneously.

Preferably, the control unit applies a waiting time interval between the measurement of the pressure, p1, at the inlet 11 and the moment when it operates a secondary vacuum pump 10. By applying such a waiting time interval, sudden short time fluctuations of the predetermined pressure value, p0, at the user's network are not affecting the functioning of the vacuum pump system 1.

Accordingly, if the customer's network experiences a sudden short time load because of for example a sudden opening of a valve, or the like, the system will have the necessary time to re-stabilize without starting and subsequently stopping a secondary vacuum pump 10, or vice-versa. However, if the predetermined pressure value, p0, at the user's network changes, the vacuum pump system 1 will meet that demand in a very short time interval and in an efficient manner, reducing the risk of starting or stopping a secondary vacuum pump based on a false change of the demand.

Furthermore, by applying said waiting time interval, the efficiency of the system is maintained without the need of using a complex control logic. Furthermore, because of such an implementation, the secondary vacuum pumps 10 are allowed to reach optimum functioning parameters.

Such a waiting time interval can be of any length, preferably selected between 10 and 50 seconds, but not limiting to, depending on the requirements of the user's network.

Further, for having a very accurate measurement of the pressure, p1, at the inlet 11, the sampling rate of such pressure value can be chosen relatively high such as for example and not limiting to: between approximately 1 second and approximately 200 milliseconds, more preferably between 700 milliseconds and 200 milliseconds, even more preferably, the sampling rate can be chosen at approximately 200 milliseconds. In another embodiment, the measurement of the pressure, p1, at the inlet 11 is performed in real time.

In yet another embodiment if all the secondary vacuum pumps 10 of the vacuum pump system 1 are running and the pressure, p1, measured at the inlet 11 is still higher than the predetermined pressure value, p0, the vacuum pump system 1 preferably increases the load of a secondary vacuum pumps 10 comprising a variable speed motor, to a first running load, $S_{run,1}$, selected between the second predetermined startup load, $S_{startup,2}$, and the second maximum load, $S_{max,2}$.

Such a secondary vacuum pump 10 can be arbitrary selected by the control unit 3, or a logic can be applied, such as for example, and not limiting to: the first or the last secondary vacuum pump 10 started, or the secondary vacuum pump 10 with the highest or the lowest number of running hours, or the secondary vacuum pump 10 with the lowest speed, or the like.

In another embodiment according to the present invention, the load of one of said secondary vacuum pumps is increased with a percentage, k1, selected between 5% and 50%, such as for example and not limiting to: 10%, or 20%, or 30%, or any other intermediary or higher value of the interval.

Consequently, the load defined by k1 can be defined by the formula:

$$\text{load}\ (k1)=S_{run,1}-S_{startup,2}.$$

It should be understood that the value of the second predetermined startup load, $S_{startup,2}$, and k1 are selected according to the requirements of the user's network.

Preferably, the control unit 3 increases the load of each of the secondary vacuum pumps 10 comprising a variable speed motor to a first running load, $S_{run,1}$, in the order of the assigned priority, if the measured inlet pressure, p1, is higher than the predetermined pressure value, p0.

For an even higher efficiency, the system can increase the load of all secondary vacuum pumps 10 having a variable speed motor. Such an increase can be performed for all secondary vacuum pumps 10 at the same time, or for one secondary vacuum pump 10 at a time, until the pressure, p1, measured at the inlet 11 is equal to or lower than the predetermined pressure value, p0.

In another embodiment according to the present invention, if the pressure, p1, measured at the inlet 11 is higher than the predetermined pressure value, p0, and the current running load, $S_{secondary}$, of the at least one secondary vacuum pump 10 is lower than the second maximum load, $S_{max,2}$, the control unit further increases the load of at least one of said secondary vacuum pumps 10 with the same percentage, k1. Accordingly, said at least one secondary vacuum pump will have a current running load, $S_{secondary}$, calculable with the formula: $S_{secondary}=S_{run,1}+[n\cdot\text{load}(k1)]$, wherein n is an natural number, preferably equal to or higher than one.

In the context of the present invention it should be understood that the formula with which the current running load, $S_{secondary}$, is calculated is an incremental function, the lowest value of n being one, and wherein n is increasing in subsequent steps by one, until the pressure, p1, measured at the inlet 11 is equal to or lower than the predetermined pressure value, p0, or until the current running load, $S_{secondary}$, is equal to the second maximum load, $S_{max,2}$.

Preferably, but not limiting to, the load of all secondary vacuum pumps 10 is increased with k1 each time the control unit identifies that the pressure, p1, measured at the inlet 11, is higher than the predetermined pressure value, p0, or until all the secondary vacuum pumps 10 are running at the second maximum load, $S_{max,2}$.

When the demand at the user's network is decreasing, and the pressure, p1, measured at the inlet 11 is lower than the predetermined pressure value, p0, the control unit 3 is preferably continuously adjusting the load of the primary vacuum pump 9 though the PI or PID controller in order to meet the demand of the user's network 4. Preferably, the control unit 3 is adjusting the load of the primary vacuum pump 9 until said primary vacuum pump reaches the first minimum load, $S_{min,1}$.

The present invention should not be restricted to such a control logic, and it should be understood that a gradual decrease in load can also be implemented, such that, if the pressure, p1, measured at the inlet 11 is lower than the predetermined pressure value, p0, the load of the primary vacuum pump 9 is gradually decreased with k0, until the pressure, p1, measured at the inlet 11 is equal to or higher than the predetermined pressure value, p0, or until the load of the primary vacuum pump 9 reaches the first minimum load, $S_{min,1}$.

If the pressure, p1, measured at the inlet 11 is still lower than the predetermined pressure value, p0, the control unit 3 reduces the load of a secondary vacuum pump 10, said secondary vacuum pump 10 comprising a variable speed motor, from the current running load, $S_{secondary}$, to the second predetermined startup load, $S_{startup,2}$.

Preferably, the system applies a waiting time interval, t2, before the load of a secondary vacuum pump 10 is reduced.

Even more preferably, the load of said secondary vacuum pump 10 is reduced with the percentage k1, at every step.

Further, the control unit 3 preferably reduces the load of the secondary vacuum pump 10 part of the group with the lowest priority first and having the highest number of running hours.

If, preferably after the waiting time interval, t2, the pressure, p1, measured at the inlet 11 is still lower than the predetermined pressure value, p0, the control unit 3 reduces the load of the secondary vacuum pump 10 with the next highest number of running hours, part of the same group. If the load of all secondary vacuum pumps 10 part of such a group has been reduced, the control unit 3 will apply the same logic for the group with the next lowest priority.

Preferably, the steps are repeated until the pressure value, p1, measured at the inlet 11 is equal or higher to the predetermined pressure value, p0.

Such a logic should, however, not be considered limiting since the control unit 3 can as well first reduce the load of the secondary vacuum pumps 10 part of the group with the highest priority and continue with the secondary vacuum pumps 10 part of the group with the next highest priority.

In another embodiment according to the present invention, the control unit 3 reduces the load of all the secondary vacuum pumps 10 having a variable speed motor with k1 each time the pressure, p1, measured at the inlet 11 is higher than the predetermined pressure value, p0, or until the current running load, $S_{secondary}$, is equal to the second predetermined startup load, $S_{startup,2}$. The load can be reduced for all secondary vacuum pumps 10 at the same time, or by selecting one secondary vacuum pump 10 at a time.

In another embodiment according to the present invention, the control unit 3 first reduces the load of the secondary vacuum pumps 10 and only after all said secondary vacuum pumps 7 reach a running load equal to the second predetermined startup load, $S_{startup,2}$, and the pressure, p1, measured at the inlet 11 is still lower than the predetermined pressure value, p0, then the control unit gradually decreases the load of the primary vacuum pump 9 with k0, until the pressure, p1, measured at the inlet 11 is equal to or higher than the predetermined pressure value, p0, or until the load of the primary vacuum pump 9 reaches the first minimum load, $S_{min,1}$.

In a preferred embodiment, the system applies a waiting time interval, t1 or t2, before operating any vacuum pump 2, for both: reducing (t2) and increasing (t1) the load.

Figure 2:
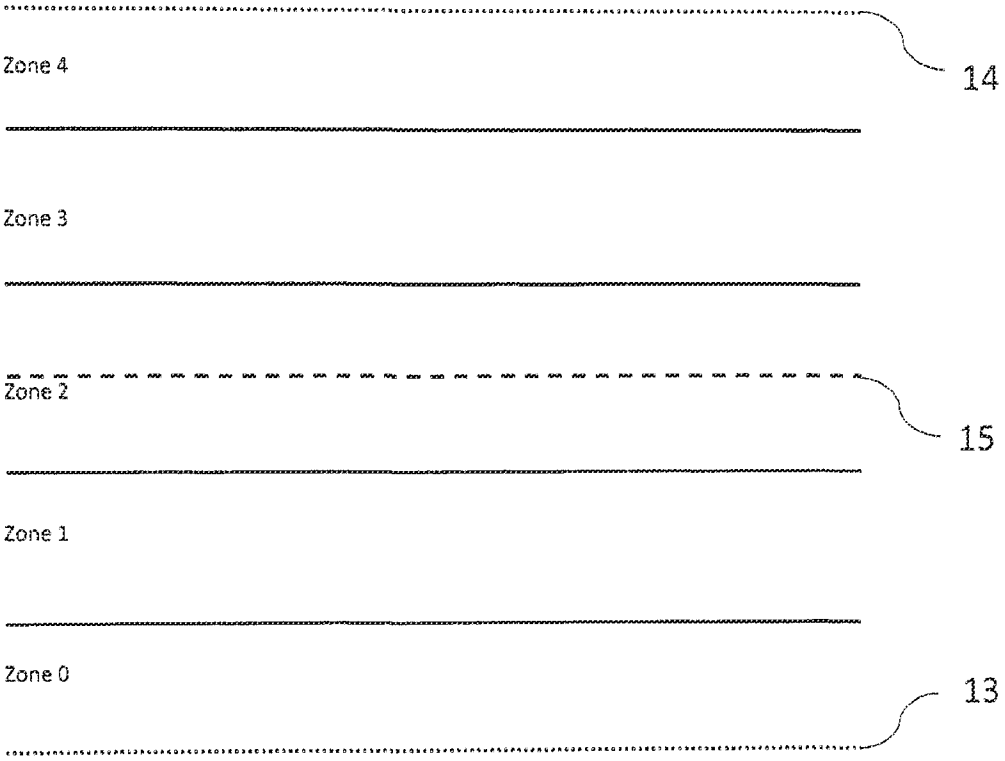
FIG. 2 schematically illustrates a split of the achievable maximum and minimum pressures of the vacuum pump system of FIG. 1 into five pressure bands according to an embodiment of the present invention; and, FIG. 3 schematically represents the specific energy requirement (SER) curve for oil injected vacuum pumps.

Preferably, as illustrated in FIG. 2, after the predetermined pressure value, p0, is communicated to the control unit 3, said control unit 3 creates five virtual pressure zones: Zone zero to Zone four, between the absolute maximum value 13 of the pressure p1 obtainable by the vacuum pump system 1 at the inlet 11 and the absolute minimum value 14 of the pressure p1 obtainable by the vacuum pump system 1 at the inlet 11. Preferably, the predetermined pressure value, p0, is positioned in the middle zone, Zone two, indicated with 15 in FIG. 2.

The control unit 3 further defines different waiting time intervals t1 and t2 for each of the five zones. Preferably, said waiting time intervals, t1 and t2 have lower values assigned for Zone zero and Zone four than for Zone one and Zone three.

Preferably, within Zone two the waiting time intervals t1 and t2 do not apply, since the predetermined pressure value, p0, is obtained.

It should be further understood that if the modulus of the difference $\Delta P=|p1-p0|$ is falling within Zone four or Zone three, the control unit will either reduce the load of the vacuum pumps 2 or stop a vacuum pump 2, and therefore uses t2 as waiting time interval.

If the modulus of the difference $\Delta P=|p1-p0|$ is falling within Zone zero or Zone one, the control unit 3 will increase the load of the vacuum pumps 2 or start a vacuum pump 2, and therefore will use t1 as waiting time interval.

For the simplicity of the calculations, but not limiting to, t1 selected for Zone zero is approximately equal to t2 selected for Zone four, and, t1 selected for Zone one is approximately equal to t2 selected for Zone three.

As an example, but not limiting to, t1 and t2 selected for Zone zero and Zone four respectively can be selected at approximately 10 seconds, ad t1 and t2 selected for Zone one and Zone three respectively can be selected at approximately 20 seconds or approximately 30 seconds. It should be further understood that the above mentioned waiting time intervals are not limiting for the present invention, and that any other values are possible. Another possibility is for t1 and t2 to slightly differ from each other in Zone zero and Zone four, as well as in Zone one and Zone three respectively.

In another embodiment according to the present invention, the five virtual pressure zones: Zone zero to Zone four are selected depending on the capacity of the buffer vessel 6. Accordingly, if the buffer vessel 6 is of a relatively high capacity, the virtual pressure zones: Zone zero to Zone four will be smaller, whereas if the buffer vessel 6 is of a relatively low capacity, the virtual pressure zones: Zone zero to Zone four will be bigger.

If, after reducing the load of all the secondary vacuum pumps 10 to the second predetermined startup load, $S_{startup,2}$, the pressure, p1, measured at the inlet 11 is still lower than the predetermined pressure value, p0, the control unit 3 stops the secondary vacuum pump 10 having the most number of running hours from the group with the lowest priority assigned to it.

If the pressure, p1, measured at the inlet 11 is still lower than the predetermined pressure value, p0, the control unit 3 is preferably subsequently stopping another still running secondary vacuum pump 10 having the second highest number of running hours, said secondary vacuum pump 10 being part of the same group, with the lowest priority assigned to it. If such a group does not have another secondary vacuum pump 10 that can be stopped, the control unit 3 stops a secondary vacuum pump 10 part of the group with the next lowest priority assigned to it.

Further, the control unit 3 applies the same logic until the pressure, p1, measured at the inlet 11 is equal or higher than the predetermined pressure value, p0, or until all the secondary vacuum pumps 10 are stopped.

If a group comprises both: secondary vacuum pumps 10 having a fixed speed motor and secondary vacuum pumps 10 having a variable speed motor, the control unit 3 will preferably first reduce the load of all the secondary vacuum pumps 10 having a variable speed motor of the entire vacuum pump system 1, and, subsequently, stop the secondary vacuum pump 10 having the highest number of running hours from the group with the lowest priority assigned, irrespective if such a secondary vacuum pump 10 comprises a fixed speed motor or a variable speed motor.

In another embodiment according to the present invention, if after all the secondary vacuum pumps 10 have been stopped, the pressure, p1, measured at the inlet 11 is still lower than the predetermined pressure value, p0, the control unit 3 stops the primary vacuum pump 9.

In another embodiment according to the present invention, if the pressure, p1, measured at the inlet 11 is lower than the predetermined pressure value, p0, and the control unit 3 has previously reduced the load of all the secondary vacuum pumps 10 to the second predetermined startup load, $S_{startup,2}$, the control unit 3 preferably performs a comparison for all the vacuum pumps 2 part of the vacuum pump system 1, in order to identify the vacuum pump 2 having the highest number of running hours. The control unit 3 further stops such a vacuum pump 2.

In yet another embodiment according to the present invention, if the pressure, p1, measured at the inlet 11 is lower than the predetermined pressure value, p0, and the control unit 3 has previously reduced the load of all the secondary vacuum pumps 10 to the second predetermined startup load, $S_{startup,2}$, the control unit 3 preferably performs a comparison for the vacuum pumps 2 part of the group with the lowest priority assigned to it. The control unit 3 identifies the vacuum pump 2 with the highest number of running hours part of said group and stops it.

If this vacuum pump 2 was previously identified as being the primary vacuum pump 9, the control unit identifies the vacuum pump 2 with the lowest number of running hours part of the group with the highest priority assigned to it from the remaining running vacuum pumps 2 as being the new primary vacuum pump 9.

In another embodiment according to the present invention, but not limiting to, the control unit 3 can identify as the new primary vacuum pump 9, the vacuum pump 2 with the lowest number of running hours from the group with the lowest priority assigned to it.

Preferably, the control unit 3 brings the newly identified primary vacuum pump 9 to match the load of the previous primary vacuum pump 9.

The step is repeated until the pressure, p1, measured at the inlet 11 is equal to or higher than the predetermined pressure value, p0, or until when only the primary vacuum pump 9 is running.

Furthermore, it goes without saying that, during a stable operation of the vacuum pump system 1, in which the pressure value, p1, at the inlet 11 matches the predetermined pressure value, p0, the load of the vacuum pumps 2 is not modified by the control unit 3 and none of the vacuum pumps 2 are stopped or started.

In a preferred embodiment according to the present invention, if the group in which the primary vacuum pump 9 is included comprises more than one vacuum pump 2, the control unit 3 preferably monitors the number of running hours of such vacuum pumps 2 and if the primary vacuum pump 9 has more running hours than one of the vacuum pumps 2 part of said same group, the control unit 3 changes the primary vacuum pump 9 as being the one with the least number of running hours.

It is preferred that, once the priorities are assigned to each of the vacuum pumps 2 part of the vacuum pump system 1, such priorities are not changed during that functioning of the vacuum pump system 1 and they can only be changed before a subsequent start-up of the vacuum pump system 1.

If, during the functioning of the vacuum pump system 1, the pressure value, p1, at the inlet 11 matches the predetermined pressure value, p0, and the flow demand at the user's network increases, the control unit 3 preferably increases the load of a vacuum pump 2 having a variable speed motor. Such a vacuum pump 2 can either be the primary vacuum pump 9, if said primary vacuum pump 2 does not run at a first maximum load, $S_{max,1}$, or said vacuum pump 2 can be a secondary vacuum pump 10, said secondary vacuum pump 10 not running at a second maximum load, $S_{max,2}$.

As an example, it will be further described how the secondary vacuum pumps 10 part of a group are being operated, and in particular the order in which the secondary vacuum pumps 10 are being stopped. For the purpose of this example, such a group is the one having the lowest priority assigned to it.

Accordingly, we will consider that such group comprises a number of N secondary vacuum pumps 10.

If the pressure, p1, measured at the inlet 11 is lower than the predetermined pressure value, p0, preferably after the control unit 3 has decreased the load of the primary vacuum pump 9 to the load, $S_{startup,0}$, and preferably after said control unit 3 has decreased the load of all the secondary vacuum pumps 10 to the second predetermined startup load, $S_{startup,2}$, the control unit identifies the secondary vacuum pump 10, part of said group having the highest number of running hours and stops this secondary vacuum pump 10.

If the pressure, p1, measured at the inlet 11 is still lower than the predetermined pressure value, p0, the control unit 3 identifies which of the N−1 remaining running secondary vacuum pumps 10, part of said group is the one with the highest number of running hours and stops this secondary vacuum pump 10.

The step is repeated until the pressure, p1, measured at the inlet 11 is equal to or higher than the predetermined pressure value, p0, or in other words the pressure p1 falls within Zone two, as illustrated in FIG. 2, or until all the secondary vacuum pumps 10 part of said group have been stopped.

If, after all secondary vacuum pumps 10 part of this group have been stopped and the pressure, p1, measured at the inlet 11 is still lower than the predetermined pressure value, p0, the control unit 3 selects the group having the lowest priority assigned to it, from the remaining groups and applies the same logic as defined above.

The step is repeated until the pressure, p1, measured at the inlet 11 is equal to or higher than the predetermined pressure value, p0, or falls within Zone two as illustrated in FIG. 2, or until all the secondary vacuum pumps 10 of all the groups are stopped.

It should be understood that a reverse logic applies for starting the secondary vacuum pumps. Accordingly, if the pressure, p1, measured at the inlet 11 is higher than the predetermined pressure value, p0, the control unit 3 identifies the secondary vacuum pump 10 having the least number of running hours from the group with the highest priority assigned to it and starts said secondary vacuum pump 10 at a first predetermined startup load, $S_{startup,1}$, if said secondary vacuum pump 10 comprises a fixed speed motor, or at a second predetermined startup load, $S_{startup,2}$, if said secondary vacuum pump 10 comprises a variable speed motor. Preferably, the control unit 3 applies a waiting time interval t1, before starting a secondary vacuum pump 10. Such a waiting time interval, t1, preferably starting when the control unit 3 detects that the pressure, p1, measured at the inlet 11 is higher than the predetermined pressure value, p0. The control unit will start a secondary vacuum pump 10 if the pressure value, p1, measured at the inlet 11 is still higher than the predetermined pressure value, p0, after said waiting time interval, t1.

Further, the control unit 3 preferably applies a waiting time interval t2, before stopping a secondary vacuum pump 10. Such a waiting time interval, t2, starting when the control unit 3 detects that the pressure, p1, measured at the inlet 11 is lower than the predetermined pressure value, p0. The control unit 3 will stop a secondary vacuum pump 10 if the pressure, p1, measured at the inlet 11 is still lower than the predetermined pressure value, p0, after said waiting time interval, t2.

In a preferred embodiment according to the present invention, the user of the vacuum pump system 1 selects the value of the second minimum load, $S_{min,2}$ before the vacuum pumps system 1 is started. Accordingly, if second minimum load, $S_{min,2}$, is selected at a relatively higher value, the maintenance of the vacuum pumps 2 is optimized, since a better control of the number of running hours can be performed. If the second minimum load, $S_{min,2}$, is selected at a relatively lower value, the energy usage of the vacuum pump system 1 is optimized.

Because of this, the vacuum pump system 1 according to the present invention can be adapted according to the user requirements, and depending on the geographical location and accessibility or price of electricity, the vacuum pump system 1 can be adapted to provide the most efficient results.

The present invention is further directed to a vacuum pump system comprising: a primary vacuum pump 9 comprising a variable speed motor capable of running between a first minimum load, $S_{min,1}$, and a first maximum load, $S_{max,1}$. The vacuum pump system 1 further comprises at least two secondary vacuum pumps 10, connected in parallel with said primary vacuum pump 9, each of said at least two secondary vacuum pumps 10 comprising a motor capable of running between a second minimum load, $S_{min,2}$, and a second maximum load, $S_{max,2}$.

Further, a pressure sensor 12 is provided (not shown), for measuring the inlet pressure, p1, of the vacuum pump system 1 at an inlet 11 thereof and control means comprising communication means for communicating with one or more of: said primary vacuum pump 9 and said at least two secondary vacuum pumps 10.

Preferably, said control means further comprise processing means comprising an algorithm configured to apply the method according to the present invention.

Said control means can be in the shape of a control unit 3, said control unit 3 being part of the vacuum pump system 1 or part of an external computing unit or part of a cloud. Said external computing unit receiving measurement data from the vacuum pump system 1 and sending back data to said vacuum pump system 1 through a communication medium which can be either a wired communication medium or a wireless communication medium.

In an embodiment according to the present invention, said processing means can be in the shape of a processor, part of the control unit 3 or said processing means can be part of an external computing unit or the cloud.

Preferably, but not limiting to, said control unit 3 is part of the vacuum pump system 1.

In another embodiment according to the present invention, said communication means can be performed either through a wired or wireless communication medium. Preferably, said communication means are performed through a wired communication medium.

Further, the control unit 3 can communicate with the primary vacuum pump 9, and said primary vacuum pump 9 can further communicate with the secondary vacuum pumps 10 through a local control unit (not shown).

In another embodiment, the control unit 3 can communicate with all the vacuum pumps 2 of the vacuum pump system 1, case in which all the vacuum pumps 2 preferably comprise a local control unit.

In yet another embodiment, the vacuum pump system 1 further comprises a user interface (not shown) through which a user of such system can manually select at least one or even all of the following parameters: the predetermined pressure value, p0, the load $S_{startup,0}$, at which the primary vacuum pump 9 is started, the percentage, k0, with which the load of the primary vacuum pump 9 is increased, the first predetermined startup load, $S_{startup,1}$, the second predetermined startup load, $S_{startup,2}$, the percentage, k1, with which the load of the secondary vacuum pumps 10 is increased or decreased, waiting time intervals t1 and t2 for each of the five virtual zones: Zone zero to Zone four for stopping or starting a secondary vacuum pump 10, and if he either prefers the vacuum pump system 1 to run in an energy efficient mode or service maintenance efficient mode.

In a preferred embodiment according to the present invention, the at least two secondary vacuum pumps 10 each comprise either a variable speed motor or a fixed speed motor.

More preferably, at least one of said motors is a variable speed motor.

Even more preferably, all secondary vacuum pumps 10 comprise a variable speed motor.

Preferably, at least one of: said primary vacuum pump 9 and said secondary vacuum pumps 10 is an oil injected screw vacuum pump.

In another preferred embodiment according to the present invention, all the vacuum pumps 2 part of the vacuum pump system 1 are oil injected screw vacuum pumps.

Figure 3:
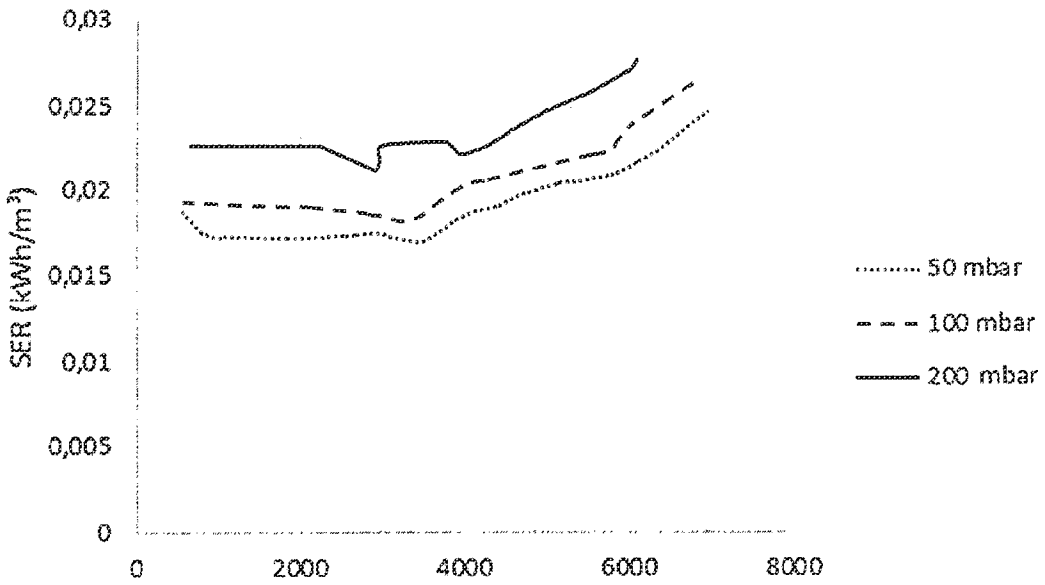

The present invention should not be limited to comprising only oil injected screw vacuum pumps, but it should be understood that the method according to the present invention can be applied to any type of vacuum pump having a specific energy requirement (SER) curve similar to the ones illustrated in FIG. 3, said SER curve indicating that the vacuum pump 2 achieves a lower value for the SER at low speeds in comparison with the value of the SER at higher speeds.

The present invention is by no means limited to the embodiments described as an example and shown in the drawings, but such a vacuum pump system 1 can be realized in all kinds of variants, without departing from the scope of the invention. Similarly, the invention is not limited to the method for operating a vacuum pump system described as an example, however, said method can be realized in different ways while still remaining within the scope of the invention.

The invention claimed is:

1. A method of operating a vacuum pump system, the method comprising the steps of:

operating a primary vacuum pump comprising a variable speed motor;

connecting at least two secondary vacuum pumps in parallel with said primary vacuum pump, each of the at least two secondary vacuum pumps comprising a motor;

dividing the at least two secondary vacuum pumps in groups, each group comprising at least one of the secondary vacuum pumps;

assigning at least a highest priority and a second highest priority for each of said groups;

conducting a first measurement of an inlet pressure measured at an inlet of the vacuum pump system;

comparing the first measured inlet pressure with a predetermined pressure value, and, if said first measured inlet pressure is higher than said predetermined pressure value, operating the at least one of the secondary vacuum pumps that is part of the group having the highest priority assigned to it;

conducting a second measurement of the inlet pressure at the inlet of the vacuum pump system;

comparing the second measured inlet pressure with said predetermined pressure value and, if, said second measured inlet pressure is higher than the predetermined pressure value, operating the at least one secondary vacuum pump that is part of the group having the second highest priority assigned to it, the method further comprising the step of starting said secondary vacuum pumps at a first predetermined startup vacuum load if the secondary vacuum pump comprises a fixed speed motor, or starting said secondary vacuum pump at a second predetermined startup vacuum load, if said secondary vacuum pump comprises a variable speed motor, wherein an assigned priority to each of said groups is based on one factor selected from the following group of factors: a price of electricity that powers the vacuum pump, an environmental condition of the vacuum pump, an accessibility of the vacuum pump for maintenance, and a wear on the vacuum pump.

2. The method according to claim 1, wherein the method repeats the step of comparing the measured inlet pressure with the predetermined pressure value and if, the subsequently measured inlet pressure is higher than the predetermined pressure value, operating the at least one secondary vacuum pump that is part of the group having a next highest priority assigned to it, until the pressure measured at the inlet reaches the value of the predetermined pressure value or until all the secondary vacuum pumps are running.

3. The method according to claim 1, wherein the group with the highest priority further comprises another one of the at least one secondary vacuum pumps, wherein operating the group with the highest priority is done by starting one secondary vacuum pump at a time, and if the measured inlet pressure is higher than the predetermined pressure value, the vacuum pump system starts the another one of the secondary vacuum pumps that is part of said group with the highest priority.

4. The method according to claim 3, wherein the group with the second highest priority further comprises another one of the at least one secondary vacuum pumps, wherein operating the group with the second highest priority is done by starting one secondary vacuum pump at a time, and if the measured inlet pressure is higher than the predetermined pressure value, the vacuum pump system starts the another one of the secondary vacuum pumps that is part of said group with the second highest priority.

5. The method according to claim 1, wherein the step of measuring the inlet pressure at the inlet of the vacuum pump system and comparing the measured inlet pressure with the predetermined pressure value occurs after a control time interval.

6. The method according to claim 5, further comprising the step of increasing the vacuum load of a secondary vacuum pump comprising a variable speed motor, to a first running load, selected between the second predetermined startup vacuum load and a predetermined second maximum load of said secondary vacuum pumps, if all the secondary vacuum pumps in the vacuum pump system are running and the measured inlet pressure is higher than the predetermined pressure value.

7. The method according to claim 6, wherein the method further comprises the step of increasing the vacuum load of each of the secondary vacuum pumps comprising a variable speed motor to a first running vacuum load in order of the assigned highest priority then the assigned second highest priority, if the measured inlet pressure is higher than the predetermined pressure value.

8. The method according to claim 6, further comprising reducing the vacuum load of the secondary vacuum pump comprising the variable speed motor, from a current running load to the second predetermined startup vacuum load, if the measured inlet pressure is lower than the predetermined pressure value.

9. The method according to claim 8, further comprising stopping the secondary vacuum pump having the most number of running hours from the group with the lowest priority, if the measured inlet pressure is lower than the predetermined pressure value.

10. The method according to claim 9, further comprising subsequently stopping another still running secondary vacuum pump having the second highest number of running hours if the measured inlet pressure is lower than the predetermined pressure value, said secondary vacuum pump having the second highest number of running hours, being part of the group with the lowest priority.

11. A vacuum pump system comprising:

a primary vacuum pump comprising a variable speed motor;

at least two secondary vacuum pumps, connected in parallel with said primary vacuum pump, each of said at least two secondary vacuum pumps comprising a motor;

a pressure sensor for measuring an inlet pressure of the vacuum pump system at an inlet thereof;

control means comprising communication means for communicating with one or more of: said primary vacuum pump and said at least two secondary vacuum pumps;

wherein said control means further comprise processing means comprising an algorithm configured to apply the method according to claim 1.

12. The vacuum pump system according to claim 11, wherein the communication means are of a wired type.

13. The vacuum pump system according to claim 11, wherein a capacity of the primary vacuum pump is different from a capacity of a first secondary vacuum pump of the at least two secondary vacuum pumps.

14. The vacuum pump system according to claim 11, wherein at least one of said motors of the secondary vacuum pumps is a variable speed motor.

15. The vacuum pump system according to claim 11, wherein at least one of said primary vacuum pump and said secondary vacuum pumps is an oil injected screw vacuum pump.

16. The vacuum pump system according to claim 11, wherein the group with a highest priority further comprises one of the at least two secondary vacuum pumps, wherein operating the group with the highest priority is done by starting one secondary vacuum pump at a time, and if the measured inlet pressure is higher than the predetermined pressure value, the vacuum pump system starts the another one of the secondary vacuum pumps that is part of said group with the highest priority.

17. The method according to claim 1, wherein the group having the highest priority is based on the vacuum pumps having a highest capacity.

18. The method according to claim 1, further comprising re-assigning the at least highest priority and the second highest priority for each of the groups after a start-up of the vacuum pump system.

19. The method according to claim 1, further comprising creating virtual pressure zones between an absolute maximum pressure and an absolute minimum pressure of the inlet pressure, wherein different waiting time intervals are provided for starting and stopping the groups of secondary vacuum pumps for each different virtual pressure zones.

20. The method according to claim 1, wherein the assigned priority to each of said groups is changed based on one factor selected from the following group of factors: the price of electricity that powers the vacuum pump, and the wear on the vacuum pump.

* * * * *